US005464070A

United States Patent [19]

Griek et al.

[11] Patent Number: 5,464,070

[45] **Date of Patent: * Nov. 7, 1995**

[54] STANCHION ASSEMBLY

[75] Inventors: Cornelis J. Griek; Anthony K. Mitchinson, both of Victoria, Australia

[73] Assignee: DGS Property Pty. Ltd., Australia

[ * ] Notice: The portion of the term of this patent subsequent to Oct. 11, 2011, has been disclaimed.

[21] Appl. No.: 60,096

[22] Filed: May 10, 1993

Related U.S. Application Data

[63] Continuation-in-part of Ser. No. 646,776, Mar. 1, 1991, Pat. No. 5,353,891.

[30] Foreign Application Priority Data

May 8, 1992 [AU] Australia ..... PL 2325/92

[51] Int. Cl.[6] ..... B21F 27/00

[52] U.S. Cl. ..... 182/45; 182/113; 256/59; 248/228

[58] Field of Search ..... 182/45, 113; 248/228, 248/231.4; 256/DIG. 6, 60, 59, 68; 403/400, 396

[56] References Cited

U.S. PATENT DOCUMENTS

| | | | |
|---|---|---|---|
| 462,319 | 11/1891 | Loehner et al. . | |
| 1,836,197 | 10/1928 | Soule . | |
| 2,392,932 | 1/1946 | Mocketl | 403/389 X |
| 3,077,613 | 11/1959 | Mayer . | |
| 3,232,393 | 2/1966 | Attword | 403/389 X |
| 3,358,957 | 12/1967 | Lindenmuth . | |
| 3,480,242 | 11/1969 | Cleveland . | |
| 3,480,257 | 11/1969 | Bourn et al. . | |
| 3,863,900 | 2/1975 | Dagiel et al. . | |
| 3,880,405 | 4/1975 | Brueske . | |
| 3,920,221 | 11/1975 | Berry et al. . | |
| 3,995,833 | 12/1976 | McLaughlin et al. . | |
| 4,037,824 | 7/1977 | Whitmer . | |
| 4,078,772 | 3/1978 | Carbone . | |
| 4,171,032 | 10/1979 | Woolslayer et al. . | |
| 4,666,131 | 5/1987 | Kettelkamp, Sr. et al. . | |
| 4,774,386 | 9/1988 | Goodwin | 403/385 X |

FOREIGN PATENT DOCUMENTS

| | | | |
|---|---|---|---|
| 857321 | 9/1910 | France . | |
| 2408752 | 7/1979 | France . | |
| 2520417 | 7/1983 | France . | |
| 2589182 | 4/1987 | France . | |
| 864334 | 1/1953 | Germany . | |
| 426827 | 11/1947 | Italy | 403/396 |

*Primary Examiner*—Alvin C. Chin-Shue
*Attorney, Agent, or Firm*—Lucas & Just

[57] ABSTRACT

A stanchion assembly comprises a stachion which is supported from the end of a purlin by a clamping assembly comprising a single clamp and a connection rod. The clamp defines a throat into which a distal lip of the purlin is received and the connection rod may also be received in the throat or in a separate sleeve.

18 Claims, 3 Drawing Sheets

STANCHION ASSEMBLY

This is a continuation-in-part application of U.S. Ser. No. 646,776 filed Mar. 1, 1991, U.S. Pat. No. 5,353,891, issued Oct. 11, 1994.

The present invention relates to frame buildings, especially steel framed buildings, and is particularly concerned with an adjustable stanchion assembly for a frame building and capable of carrying a structure on the building.

Structures which may be advantageously supported on a building, or a building construction, include especially a safety barrier, for example, to prevent or assist in preventing site workers accidently falling from the construction, and display signs. A safety barrier may advantageously be sufficiently secure to have connected to it a fall arrest system whereby someone connected to the safety barrier may be protected from serious injury in an accidental fall. In order to provide adequate support, it is necessary that a stanchion assembly be securely connected to the building and readily appropriate for use in different situations including on different frame buildings. It is advantageous if the stanchion assembly can be readily removed from the building, for example, in the case of a stanchion assembly associated with a safety barrier, when the building construction has been substantially completed.

Our Australian patent specification 38664/89 (or any overseas equivalent thereof derived from International Patent Application PCT/AU89/00291 the disclosure of which is incorporated herein by reference, including U.S. Ser. No. 646776, all or any of which are hereinafter referred to as "the earlier application") proposes such an adjustable stanchion assembly.

According to the prior invention there is provided an adjustable stanchion assembly for a frame building, comprising a support post capable of receiving a structure to be carried by the assembly and secured to a clamping mechanism comprising an elongated connection member and at least two clamps which are selectively relatively adjustable along the elongate connection member and which comprise means for engaging the clamps with one or more of the frame members of the frame building, each said clamping means comprising jaws having a mouth of restricted maximum width and a throat portion behind the mouth having a dimension substantially parallel to the width of the mouth which is greater than said maximum width whereby an L-shaped section of the frame member having a distal leg of greater height than the maximum width of the mouth can only be received in and removed from the jaws by relative rotation of the clamp around said L-shaped section.

The stanchion assembly of the prior invention is particularly adapted for use with, for example, C- or Z-shaped purlins or girts which have a lip at each end defining the distal leg of an L-shaped section of the purlin or girt. However, that stanchion assembly is also suitable for use with other shapes of frame member, including I-beams, provided they have a flange which can be received in at least the mouth of the clamps.

By the term "frame building" is meant a building or building construction having at least one frame member to which the adjustable stanchion assembly of the invention can be affixed. Thus, for example, only the roof or floor construction of the building may be frame-like or the whole building may comprise a frame construction.

The stanchion assembly may be connected to one or more frame members of a wall structure so that the elongate connection member extends upright or the elongate connection member may be clamped to one or more floor or roof frame members which extend horizontally or otherwise. Generally, the support post of the stanchion assembly will extend upwardly from the clamping mechanism, but in some circumstances it may be desirable to have it projecting downwardly or outwardly from the building.

The support post conveniently is adjustably secured to the clamping mechanism, preferably at one end, for example by a sleeve construction and a locking device, and may be removable from the clamping mechanism for storage and transportation purposes. The adjustability of the securement of the support post to the clamping mechanism is particularly convenient where the portion of the elongate connection member to which the support post is secured projects outwardly from the building since it will permit variation of the distance between the support post and the building. Conveniently, the support post is variable in length, and this may be by way of a telescopic construction. The support post may include means by which the structure to be carried by the stanchion assembly may be mounted thereon, for example wedging means to receive the generally horizontal rails of a safety barrier and/or hooks to engage netting extending between adjacent stanchion assemblies.

One of the at least two clamps of the clamping mechanism may be rigidly connected with the support post or with a bracket of or for the support post which engages the connection member, whether or not the support post is adjustably secured to the elongate connection member, but preferably the at least two clamps are selectively adjustable along the elongate connection member and relative to the support post.

Advantageously, the clamping mechanism is such that the at least two clamps cannot be rotated relative to the elongate connection member and this may be by providing the connection member and the co-operating parts of the clamping mechanism with a suitable key and keyway arrangement. However, preferably the elongate connection member comprises a rod of non-circular cross-section, for example square, which may be received in a sleeve of corresponding cross-section in the or each clamp which is selectively adjustable along the elongate connection member. Releasable locking means may also be provided to selectively resist the adjustment along the connection member.

The provision of a clamping mechanism comprising the elongate connection member and at least two clamps permits the connection member to extend across two or more laterally extending frame members and one clamp to be secured to each. Where the frame members have the aforementioned L-shaped section, this arrangement prevents rotation of the clamping mechanism relative to the frame members so that the clamping mechanism cannot be disengaged from the frame members unless it is slid off the end of the frame members, or the clamps are disengaged from the connection member. Likewise, if the at least two clamps are engaged with opposite flanges of an I-beam or of two I-beams extending laterally of the connection member, the clamping mechanism will resist disengagement from the I-beams(s). The elongate connection member may also be clamped lengthwise to a single frame member having an L-shaped section as aforementioned. Rotation of the clamps to possibly disengage the clamping means is not prevented by the last-mentioned arrangement, but may be resisted by the substantially rigid connection of the stanchion assembly with a second stanchion assembly, such as by means of a horizontal rail associated with a safety barrier, or by bracing at least one of the clamps against rotation by means of a bracing member which extends from said clamp to a further clamp engaged with a second laterally spaced frame member. Nevertheless, it is preferred that the jaws of each clamp include releasable locking means adapted to secure the clamp on the frame member and this may be by means of one or more screw threaded locking bolts arranged, for example, to engage the frame member in or adjacent the mouth of the jaws.

Advantageously, the jaws of each clamp are elongate whereby they are adapted to act on a longitudinally extensive section of the frame member and conveniently they are formed from sheet material to define a substantially tubular throat with an elongate slot in the tube wall forming the mouth.

The present invention provides a stanchion assembly having a modified clamping arrangement compared to that described above.

According to the present invention there is provided an adjustable stanchion assembly for a frame building (as herein defined) comprising at least one elongate frame member which includes a distal lip extending along a flange of the frame member to define an L-shaped section, the assembly comprising a support post for a safety barrier and a clamping mechanism for the support post, the clamping mechanism comprising an elongate connection member of non-circular cross-section and a single clamp which is selectively adjustable along and non-rotatable relative to the connection member, the clamp being engageable with said frame member, and comprising a pair of opposed longitudinally extensive open-ended jaws adapted to receive a longitudinal portion of the L-shaped section of said frame member through an open side of the jaws, and means to resist withdrawal of said portion of the one frame member from the jaws, and wherein the clamp comprises means defining a passage of non-circular cross-section to slidingly receive the connection member in non-rotatable manner and means to resist the relative sliding movement, said passage means extending parallel to the pair of open-ended jaws whereby in use the elongate connection member extends parallel to said at least one frame member.

Preferably, the support post is supported in cantilevered manner from the frame member by the clamping mechanism.

The stanchion assembly is particularly adapted for use with, for example, C- or Z-shaped purlins or girts which have a distal lip along the top or bottom flange thereof. However, the stanchion assembly is also suitable for use with other shapes of frame members, including I-beams, provided they have a flange which can be received by the jaw of the clamp.

The term "frame building" means a building or building construction having at least one frame member to which the adjustable stanchion assembly of the invention can be affixed. Thus, for example, only the roof or floor construction of the building may be frame-like or the whole building may comprise a frame construction.

In a preferred embodiment described in the earlier application the clamp may advantageously comprise jaws having a mouth of restricted width and a throat portion behind the mouth having a dimension substantially parallel to the width of the mouth which is greater than the restricted width. Where the at least one frame member includes a distal lip whose height is greater than the restricted width of the respective clamp, the flange can only be received in and withdrawn from the jaws by relative rotation of the clamp around the leg.

Thus, further according to the present invention there is provided an adjustable stanchion assembly comprising a support post for a safety barrier and a clamping mechanism for clamping the support post to a frame building, the clamping mechanism comprising an elongate connection member of non-circular cross-sectional shape and a single clamp which is selectively adjustable along the elongate connection member, said clamp including a passage means, said clamp being slidably mounted on said connection member by said connection member extending through said passage means, said passage means having an internal configuration of a cross-sectional shape that, in combination with the non-circular cross-sectional shape of said connection member, makes said clamp non-rotatable with respect to said connection member, said clamp being adapted to be clamped to an elongate frame member of a frame building wherein said frame member includes an elongate flange and a distal lip extending along the flange, said clamp comprising a pair of opposed longitudinally extensive open-ended jaws which defines a mouth of restricted width and a throat portion behind the mouth having a dimension substantially parallel to the width of the mouth which is greater than said restricted width, said distal lip having a greater height than the restricted width of said mouth, whereby said flange with a distal lip is received in and removed from the jaws by relative rotation of the clamp around said flange with a distal lip, said connection member extending along the frame member and said support post being secured to the connection member with said support post supported in cantilevered manner from the frame member by the clamping mechanism.

The restricted mouth may be defined by a fixed lip of the mouth whereby the fixed lip resists withdrawal of the frame member flange from the jaws, but advantageously the jaws include releasable locking means adapted to secure the clamp on the frame member, for example by means of one or more screw threaded locking bolts arranged, preferably, to engage the frame member in or adjacent the mouth of the jaws. In this arrangement, the releasable locking means resist withdrawal of the frame member flange from the jaws and, alone or with the aforementioned lip or other projections in the mouth, may define the restricted mouth.

In a most preferred embodiment the jaws are substantially in the form of a tube the interior of which defines the throat portion with an elongate slot in said tube forming the mouth.

The clamping mechanism is such that the clamp cannot be rotated relative to the elongate connection member and this may be by providing the connection member and the co-operating parts of the clamping mechanism with a suitable key and keyway arrangement. However, preferably the elongate connection member comprises a rod, which may be hollow, of, for example, square cross-section which may be received in the passage means of corresponding cross-section in the clamp. Releasable locking means is provided to selectively resist the adjustment of the clamp along the connection member.

The clamp passage means may comprise a sleeve sized to closely receive the elongate connection member. Alternatively, or in addition, the jaws may define the passage means whereby the aforementioned throat portion is adapted to receive the elongate connection member. If both the aforementioned sleeve is provided and the throat portion is sized to receive the connection member, either may be used as desired.

Rotation of the clamp once it is located on the frame member may be resisted by the substantially rigid connection of the stanchion assembly with a second stanchion assembly, such as by means of a horizontal rail associated with a safety barrier, or by bracing the clamp against rotation by means of a bracing member which extends from said clamp, for example, to a further clamp engaged with a second laterally spaced frame member. The clamp may include a sleeve for slidingly receiving a bracing member therein substantially normal to the passage means, and releasable locking means to resist said sliding.

The support post conveniently is adjustably secured to the clamping mechanism, preferably at one end, for example by a sleeve construction and a locking device, and may be removable from the clamping mechanism for storage and transportation purposes. The adjustability of the securament of the support post to the clamping mechanism is particularly convenient where the portion of the elongate connection member to which the support post is secured projects outwardly from the building since it will permit variation of the distance between the support post and the building. Conveniently the support post is variable in length, and this may be by way of a telescopic construction. The support post may include means by which the structure to be carried by the stanchion assembly may be mounted thereon, for example wedging means to receive the generally horizontal rails of a safety barrier and/or hooks to engage netting extending between adjacent stanchion assemblies.

One embodiment of a stanchion assembly in accordance with the present invention will now be described by way of example only with reference to the accompanying drawings in which.

The various embodiments of stanchion assembly described hereinafter are closely similar in many respects and, for convenience only, where the same or similar parts are referred to, the same reference numerals will be used.

Figure 1:
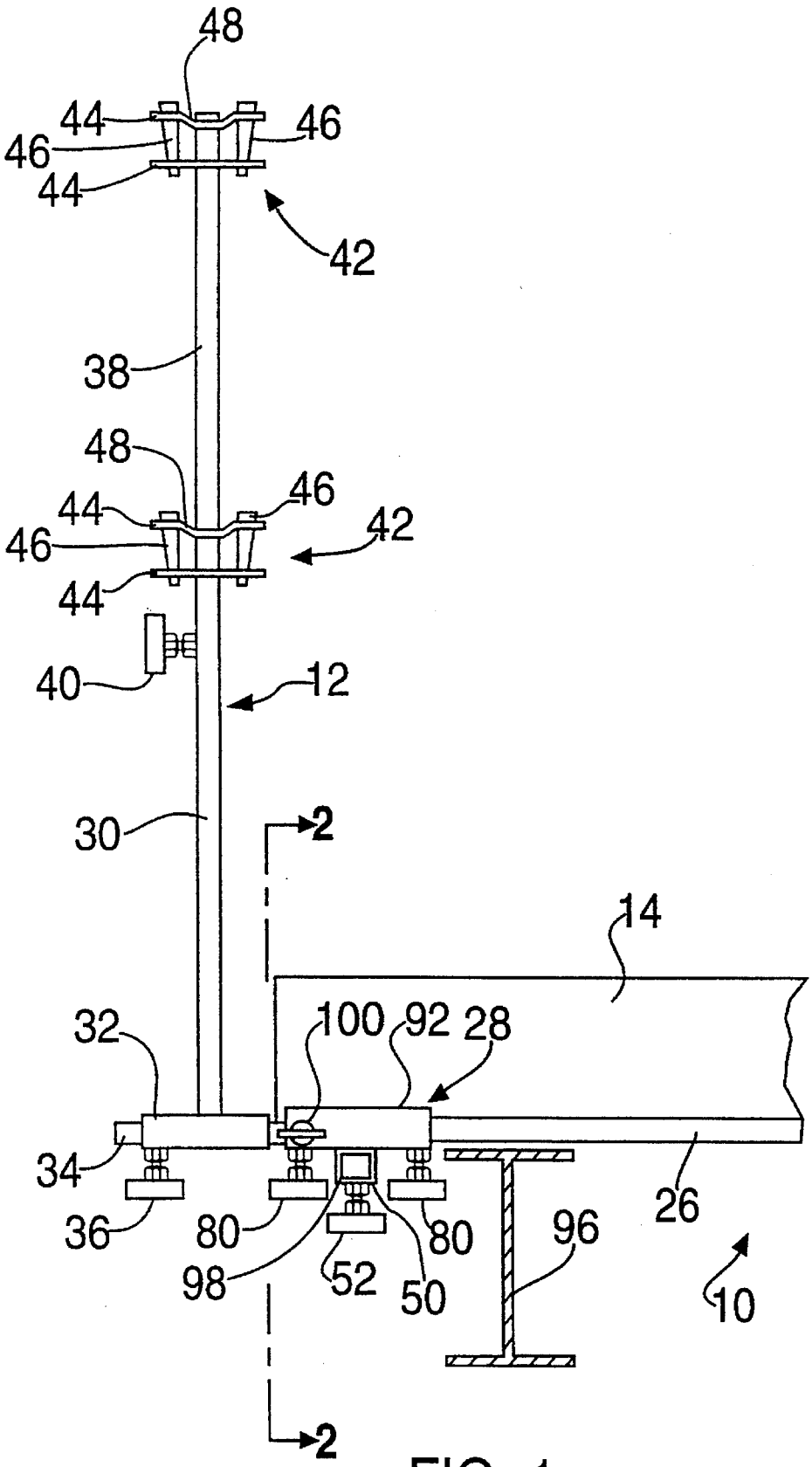
FIG. 1 is a side view of a first embodiment of the stanchion assembly engaged with a roof supporting purlin of a building.

Referring firstly to FIG. 1, an adjustable stanchion assembly 10, including an upright stanchion 12, is shown secured to a single metal purlin 14 which is intended to support a roof (not shown in dashed lines) and which spans a plurality of I-beams 96 (one only shown).

Purlin 14 is shown as "Z"-shaped but for the purposes of the invention purlin 14 could be C-shaped. Other shapes are also possible. The purlin includes a central web 20, an upper flange (not visible) on which the roof is to be supported and a bottom flange 24 which is L-shaped in cross-section having a leg 24*a* connected to the web 20 and a lip 24*b* projecting from the leg 24*a* (shown most clearly in FIG. 2).

The stanchion assembly 10 includes a clamping mechanism which comprises a connecting rod 26 which extends parallel to the purlin 14 adjacent the lip 24*b*. The connecting rod is of square tubular cross-section and is supported relative to the purlin 14 by a clamp 28 to be described in detail hereinafter. The stanchion 12 of the assembly 10 comprises a lower support post 30 which is tubular and has welded at its lower end a sleeve 32 of square cross-section whose axis extends perpendicularly to that of the lower support post 30. The sleeve 32 is closely received in sliding manner on a projecting end portion 34 of the connecting rod 26 and is lockable in the desired location by means of a screw threaded locking bolt 36 which threadedly engages the sleeve and projects through the sleeve wall to abut the end portion 34 of the connecting rod.

The lower support post 30 telescopically receives an upper support post 38 which can be locked at the desired height by means of a locking bolt 40 of similar construction to the locking bolt 36. The upper support post 38 carries a pair of barrier mounts 42 each of which has a pair of spaced plates 44 welded to the upper support post 38 and having aligned apertures therethrough to receive wedge shaped pegs 46. Each of the barrier mounts 42 is shown with a barrier rail 48 locked in place between the respective spaced plates 44 by means of the peg 46 forcing the barrier rail into abutment with the upper support post 38. Each barrier mount 42 is preferably capable of receiving at least one barrier rail 48 both transversely to the plane of FIG. 1 as shown and parallel to the plane of the Figure. As shown in FIG. 1 each barrier mount 28 has two pegs 46 for receiving a barrier rail 48 on either or both sides of the upper support post 38. The other end of the barrier rails 48 are supported on a second stanchion assembly 10 (not shown) clamped to a further purlin. In an alternative embodiment, or in addition to the barrier mounts 28, the stanchion 12 may carry hooks or other devices to support netting or webbing between the stanchions 12 of the two spaced assemblies 10.

Figure 2:
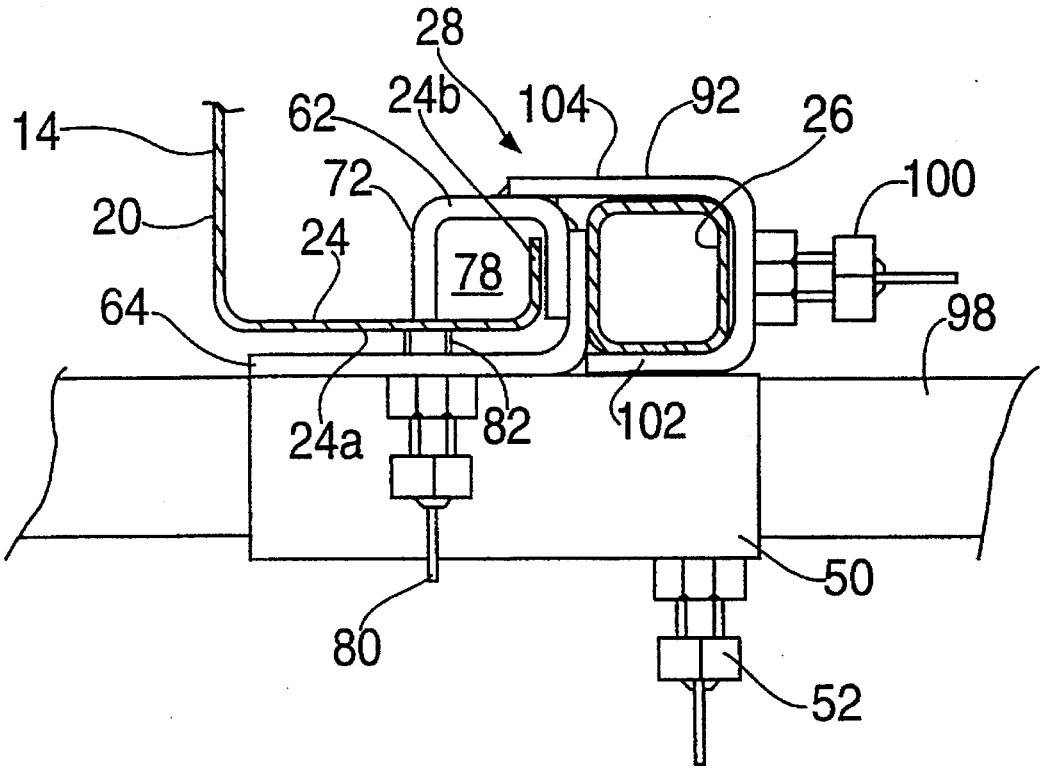
FIG. 2 is an enlarged detail taken along the line 2—2 in FIG. 1.

Referring now to FIG. 2 in which the clamp 28 is shown in greater detail, the clamp comprises a sleeve 50 of square cross-section to closely receive a bracing rod 98 in sliding manner. The sleeve 50 has a locking bolt 52, which is of similar construction to the locking bolt 36, to secure the bracing rod in the sleeve. The locking bolt 52 comprises a wing 54 welded to a threaded nut 56 from which a screw threaded stud 58 fixedly projects. The stud 58 screw threadedly engages a threaded nut 60 welded to the wall of the sleeve 50 and the nut 60 overlies an aperture (not shown) in the wall of the sleeve so that the stud 58 can project therethrough to engage the bracing rod 26. The bracing rod can be engaged in similar manner with an adjacent purlin to resist rotation of the clamp on purlin 14, but may not be necessary.

The sleeve 50 of the clamp 28 is welded to a generally sleeve like clamping means 62 whose axis extends transversely of the sleeve 50 to engage the bottom flange 24 of the purlin 14. The clamping means 62 comprises an elongate L-shaped steel section 64 whose longer leg 66 is welded to the sleeve 50 and whose upstanding leg 68 is welded to one leg 70 of an inverted U-shaped steel section 72. The opposite leg 74 of the U-shaped section 72 is spaced slightly from the opposing leg 66 of the L-shaped section 64 to define an endless narrow mouth 76 through which the lip 24*b* of the flange 24 of the purlin can be received. The sections 64 and 72 of the clamping means 62 together define an enlarged throat 78 inwardly of the mouth 76 whose height is greater than the height of the lip 24*b*. The lip 24*b* has a greater height than the spacing between the leg 74 of section 72 and leg 66 of section 64. Thus, flange 24 can only be received in the throat 78 by inserting the lip 24*b* through the mouth 76 and rotating the clamp 28 around the junction between the leg 24*a* and lip 24*b* of the flange. Likewise, the clamp 28 can only be removed from the flange 24 by rotating the clamp over the lip 24*b*.

It is preferred to lock the clamp 28 onto the purlin 14 and for this purpose a locking bolt 80 is provided which is identical to the locking bolt 52 and whose stud 82 projects through the leg 66 of section 64 to engage the flange 24 in the throat adjacent the mouth 76 and thereby urge the leg 24*a* into abutment with the end portion of the leg 74 of the section 72. Preferably, two locking bolts 80 are provided, one located on each side of the sleeve 50, generally as shown in FIG. 1. The locking bolts 80 may replace the leg 74 of the section 72 altogether.

The clamping means 62 may be formed in one piece, as described hereinafter, so that the leg 68 of section 64 is continuous with leg 70 of section 72.

Figure 3:
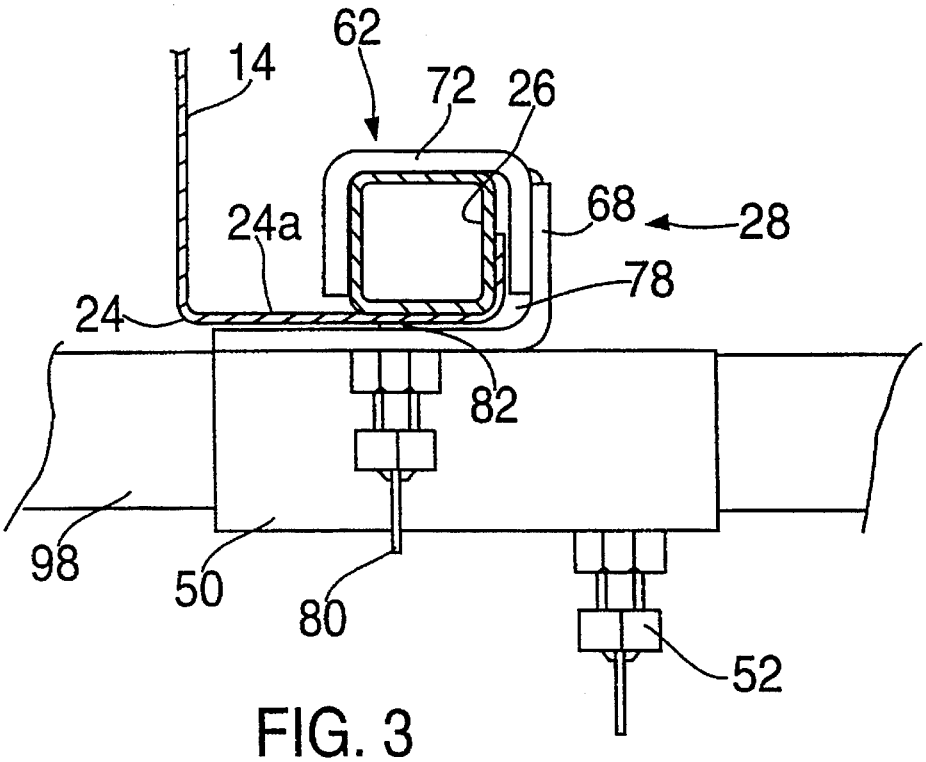
FIG. 3 is a view similar to FIG. 2 illustrating a modified clamp.

In one embodiment, the throat 78 of the clamping means 62 is sized to receive the connecting rod 26 as shown in FIG. 3, to be described hereinafter, but in the embodiment of FIGS. 1 and 2 a sleeve 92 is provided to accommodate the connecting rod 26 which extends parallel to the purlin 14.

The sleeve 92 on clamp 28 is formed by an elongate J-shaped metal section of which the shorter leg 102 is welded to the sleeve 50 and the longer leg 104 overlies and is welded to the base of the U-shaped section 72 of the clamping means 62. The sleeve 92 has a square internal cross-section and is shaped to closely receive the connecting rod 26 in sliding manner with such sliding being selectively prevented by the locking bolt 100. The close fit of the rod 26 in the sleeve 92 prevents relative rotation.

Referring now to FIG. 3, as briefly described already the arrangement described with reference to FIGS. 1 and 2 is modified so that rather than providing the sleeve 92 for the connecting rod 26 extending transversely to the bracing sleeve 50, the connecting rod 26 is accommodated in a slightly enlarged throat 78 of the clamping means 62 of clamp 28.

In the arrangement of FIG. 3, the flange 24 is introduced into the throat 78 in the same manner as described with reference to FIGS. 1 and 2, the bracing rod 98 if needed is introduced into the sleeve 50 and locked in place by the locking bolt 52, the connecting rod 26 is slid through the sleeve-like throat 78 to overlie the flange 24, and with the connecting rod 26 in the correct location the locking bolts 80 are tightened so that the screw threaded stud 82 engages the leg **24*a* of the flange 24 which abuts the connecting rod 26 and urges it into engagement with the base of the U-shaped section 72. Both the connecting rod 26 and the throat 78** are of square cross-section and are sized to prevent relative rotation.

In FIG. 3 the locking bolts 80 are shown engaging the leg **24*a* within the throat 78 of the clamping means 62, whereas in FIG. 2 the locking bolts 80 are displaced slightly to engage the leg 24*a* in the mouth 76. The reason for this variation is that in FIG. 3 the leg 24*a* of flange 24 may be braced against the connecting rod 26 whereas in FIG. 2 the connecting rod 26 extends through the separate sleeve 92 and the leg 24*a* of flange 24 is braced directly against the end portion of leg 74 of the U-shaped section 72**.

Figure 4:
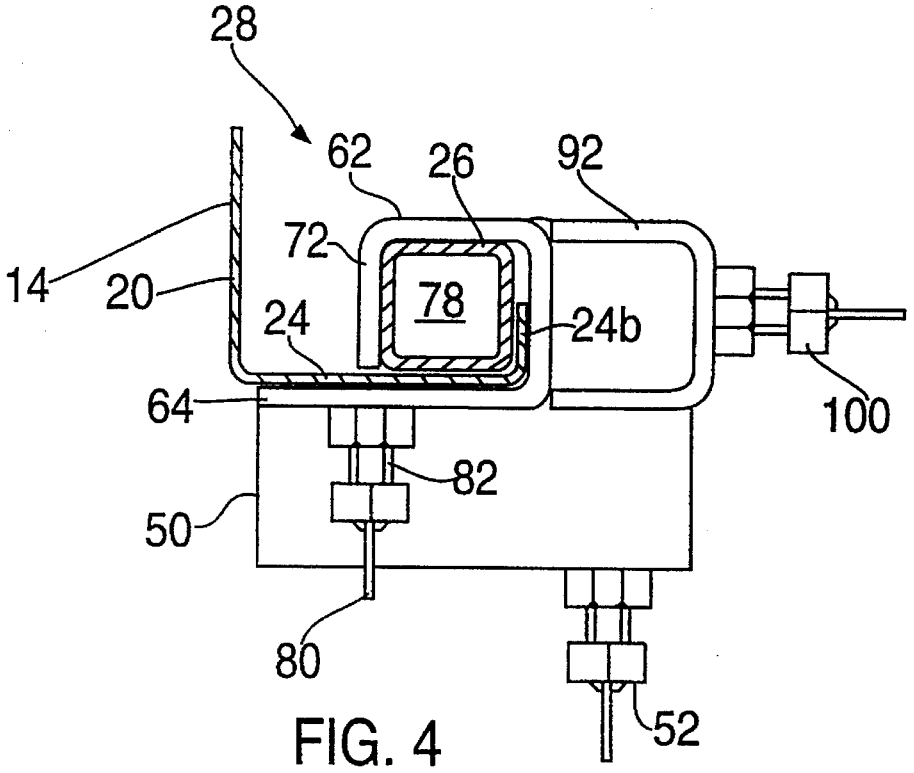
FIG. 4 is a view similar to FIG. 2 but showing a further modified clamp.

Referring now to FIG. 4, the clamp 28 is very similar to the clamp described with reference to FIGS. 1 and 2 but the clamping means 62 is folded from a single sheet of steel and the throat 78 is sized to receive the connecting rod 26 as in the embodiment described with reference to FIG. 3. The sleeve 92 is retained so as to receive the connecting rod when the rod cannot be passed through the throat 78. Such an occasion is illustrated in FIG. 5.

Figure 5:
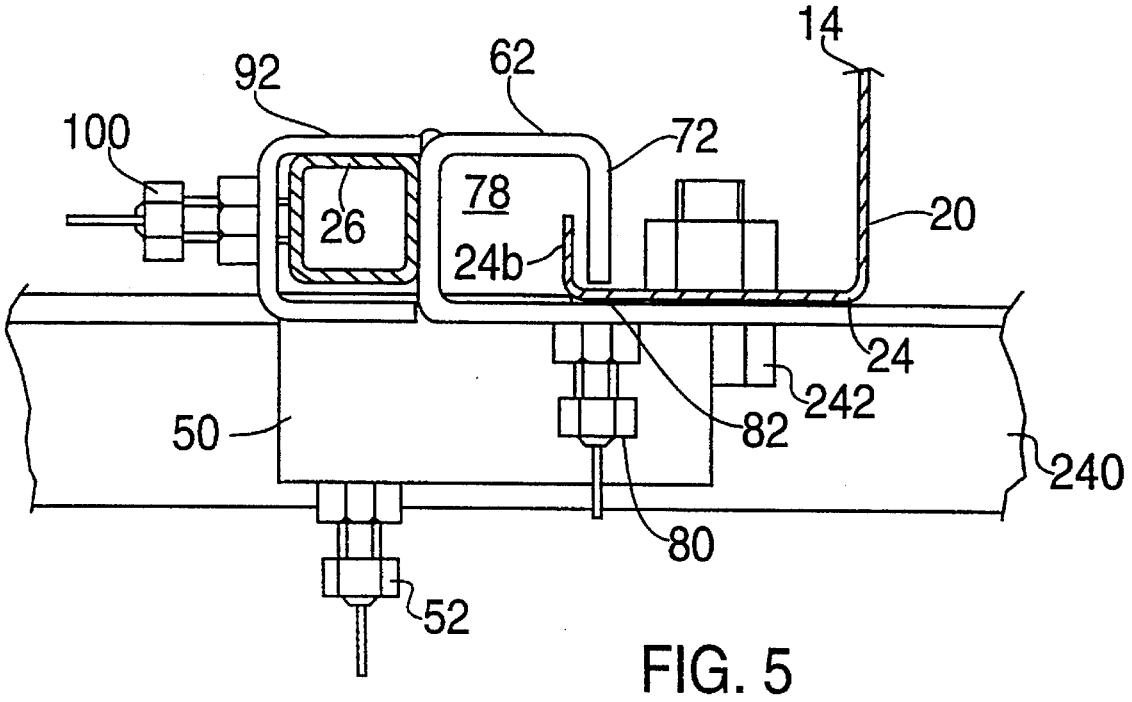
FIG. 5 is an opposite end view of the further modified clamp of FIG. 4 but shown in use in a similar manner to the clamp of FIG. 2.

In FIG. 5, the purlin 14 has an angle member 240 secured at its end (and likewise to adjacent purlins) by means of a nut and bolt assembly 242. The angle member 240 is provided to secure wall cladding. While the clamp 28 will normally be clear of the angle member and bolt, being located just in from the end of the purlin 14 as shown in FIG. 1, the connection rod 26 would be obstructed by the bolt 242 if it extended through the throat 78 of the clamping means 62 as described with reference to FIG. 4. Accordingly, in this embodiment the connection rod extends through the sleeve 92.

The construction, arrangement and operation of the stanchion assembly and components thereof illustrated in the drawings can be readily understood by reference to the preceding description. It will be seen that the described stanchion assemblies can enable a stanchion to be readily supported from purlins, beams and/or girts of a frame building and the stanchion can then be used to mount barriers, horizontal rails, barrier netting, display signs and the like. The stanchion assembly can be readily dismantled from the building for reuse at another location. Those skilled in the art will readily appreciate that many modifications and variations may be made to the stanchion assemblies described herein, and all such modifications and variations should be considered as falling within the scope of the present invention. In particular, it will be appreciated that the restricted mouth of the clamps may be defined by pegs or other projections which extend from one or both sides into an open side of the enlarged throat.

The claims defining the invention are as follows:

1. An adjustable stanchion assembly for a frame building which has an elongated frame member, the elongated frame member having an elongated flange and a distal lip extending along the flange of the frame member to define an L-shaped section, the stanchion assembly comprising:

(A) a support post for a safety barrier;

(B) a clamping mechanism for clamping the support post to the frame building, the clamping mechanism comprising:

(B1) an elongated connection member of non-circular cross-sectional shape, and (B2) a single clamp which is adapted to be clamped to the frame member of the frame building, the clamp comprising:

(B2a) a sleeve, (B2ai) the connection member extending through the sleeve thereby making the clamp slidably mounted on the connection member and selectively relatively adjustable along the connection member, and (B2aii) the sleeve having an internal configuration of a non-circular cross-sectional shape that, in combination with the non-circular cross-sectional shape of the connection member, makes the clamp non-rotatable relative to the connection member; and (B2b) a pair of opposed longitudinally extensive open-ended jaws which are affixed to the sleeve, the jaws defining:

(B2bi) a mouth of restricted width, the distal lip of the elongated frame member having a greater height than the restricted width of the mouth; and (B2bii) a throat portion behind the mouth having a height and a width substantially parallel to the width of the mouth and which is greater than the restricted width of the mouth and at least as high as the distal lip, (B2biii) whereby the frame member can only be received in and removed from the jaws by relative rotation of the clamp around the distal lip of the flange;

(B2biv) the axis of the pair of jaws being substantially parallel to the axis of the sleeve; and (C) means for securing the support post to the connection member such that the support post is supported in a cantilevered manner from the frame member by the clamping mechanism.

2. An adjustable stanchion assembly according to claim 1 wherein the support post is adjustably secured to the clamping mechanism.

3. An adjustable stanchion assembly according to claim 1 wherein the elongate connection member comprises a rod of square cross-section.

4. An adjustable stanchion assembly according to claim 3 wherein the rod is hollow.

5. An adjustable stanchion assembly according to claim 1 wherein the sleeve further comprises a releasable locking means to prevent sliding of the connection member.

6. An adjustable stanchion assembly according to claim 1 wherein the jaws are substantially in the form of a tube the interior of which defines the throat portion with an elongate slot in said tube forming the mouth.

7. An adjustable stanchion assembly according to claim 1 wherein the clamp comprises releasable locking means adapted to secure the frame member in the pair of jaws.

8. An adjustable stanchion assembly according to claim 7 wherein the releasable locking means comprises two longitudinally spaced bolts which extend through one of the jaws and which are adjustable towards and away from the other of the jaws.

9. An adjustable stanchion assembly according to claim 1 wherein the clamp includes a second sleeve for slidingly receiving a bracing member therein, said second sleeve having an axis being substantially normal to the axis of the first-mentioned sleeve, and releasable locking means to resist sliding of said bracing member.

10. An adjustable stanchion assembly for use with a frame building which has an elongate frame member, said elongate frame member having an elongate flange and a distal lip extending along said flange, said stanchion assembly comprising:

(A) a support post for a safety barrier or the like;

(B) a clamping mechanism for clamping to said frame building, said clamping mechanism comprising:

(B1) an elongate connection member of non-circular cross-sectional shape; and (B2) a single clamp adapted to be clamped to said elongate frame member of said frame building, said clamp comprising:

(B2a) a pair of opposed longitudinally extensive jaws, said jaws defining:

(B2ai) a mouth of restricted width, said distal lip having a greater height than the restricted width of said mouth;

(B2aii) a throat portion behind said mouth having a height and width substantially parallel to the width of the mouth and which is greater than the restricted width of said mouth and at least as high as said distal lip, (B2aiii) whereby the frame member can only be received in and removed from the jaws by relative rotation of the respective clamp around said flange with said distal lip, (B2aiv) said height and width of said throat being such that when said clamp is rotated onto said flange and said distal lip and a portion of said flange are in said throat, said connection member can also extend through said throat thereby making said clamp slidably mounted on said connection member and selectively relatively adjustable along said connection member, and (B2av) said throat having an internal configuration of non-circular cross-sectional shape, which in combination with the non-circular cross-sectional shape of said connection member makes said clamp non-rotatable with respect to said connection member; and (C) means for securing said support post to said connection member of said clamping mechanism such that said support post is supported in a cantilevered manner from the frame building by the clamping mechanism.

11. An adjustable stanchion assembly according to claim 10 wherein the support post is adjustably secured to the clamping mechanism.

12. An adjustable stanchion assembly according to claim 10 wherein the elongate connection member comprises a rod of square cross-section.

13. An adjustable stanchion assembly according to claim 10 wherein the elongate connection member comprises a rod which is hollow.

14. An adjustable stanchion assembly according to claim 10 wherein the throat of said clamp further comprises releasable locking means to prevent sliding of said connection member.

15. An adjustable stanchion assembly according to claim 10 wherein the jaws of the clamp include releasable locking means adapted to secure the clamp on the frame member.

16. An adjustable stanchion assembly according to claim 15 wherein the releasable locking means comprises two longitudinally spaced bolts which extend through one of the jaws and which are adjustable towards and away from the other of the jaws.

17. An adjustable stanchion assembly according to claim 10 wherein the jaws are substantially in the form of a tube the interior of which defines the throat portion with an elongate slot in said tube forming the mouth.

18. An adjustable stanchion assembly according to claim 10 wherein the clamp further comprises a sleeve for slidingly receiving a bracing member therein substantially normal to said throat, and releasable locking means to resist sliding of said bracing member.

* * * * *